US010219617B1

(12) United States Patent
Taylor

(10) Patent No.: US 10,219,617 B1
(45) Date of Patent: Mar. 5, 2019

(54) OVERBED TABLE LOCKER

(71) Applicant: Dennis Taylor, Littlestown, PA (US)

(72) Inventor: Dennis Taylor, Littlestown, PA (US)

( * ) Notice: Subject to any disclaimer, the term of this patent is extended or adjusted under 35 U.S.C. 154(b) by 0 days.

(21) Appl. No.: 15/919,341

(22) Filed: Mar. 13, 2018

(51) Int. Cl.
*A47B 23/04* (2006.01)
*A47B 79/00* (2006.01)
*A47B 23/06* (2006.01)

(52) U.S. Cl.
CPC ..... *A47B 23/046* (2013.01); *A47B 23/06* (2013.01); *A47B 79/00* (2013.01)

(58) Field of Classification Search
CPC . A47B 79/00; A47B 23/046; A47B 2023/047; A47B 83/00; A47B 83/045; A47B 46/00
USPC ..... 108/49, 42, 26, 25, 90; 312/204, 237, 312/277, 293.3
See application file for complete search history.

(56) References Cited

U.S. PATENT DOCUMENTS 357,074 A * 2/1887 Fee ..... A47B 27/00 108/6
719,298 A * 1/1903 Berry ..... A45C 9/00 190/11
1,496,556 A * 6/1924 Romesberg ..... A47B 35/00 108/11
1,798,893 A * 3/1931 Myers ..... A47B 41/04 312/231
2,103,552 A * 12/1937 Radyx ..... A47B 83/045 297/130
2,346,919 A * 4/1944 Hillenbrand ..... A47B 23/046 108/50.15
3,188,158 A * 6/1965 Sanchez ..... A47B 3/002 108/124
3,910,659 A * 10/1975 Peterson ..... A47B 13/081 297/174 R
4,400,951 A * 8/1983 Cherry ..... A47B 83/04 108/50.13
4,401,036 A * 8/1983 Russo ..... A47B 23/046 108/106
4,659,154 A * 4/1987 Jenkins ..... A01K 97/26 269/907
5,098,174 A * 3/1992 Worthley ..... A47B 81/02 108/26
5,651,152 A 7/1997 Ritchie
(Continued)

FOREIGN PATENT DOCUMENTS

WO 2009152429 12/2009

*Primary Examiner* — Jose V Chen
(74) *Attorney, Agent, or Firm* — Kyle A. Fletcher, Esq.

(57) ABSTRACT

The overbed table locker is a locking case configured for use with the table top of an overbed table. The overbed table locker attaches to the tabletop. The overbed table locker securely stores the domestic articles within the overbed table locker. The overbed table locker comprises a container, a lid, a plurality of hinges, a plurality of lid supports, a locking latch, a fastening device, and a cupholder. The plurality of hinges attaches the lid to the container. The plurality of lid supports controls the opening and the closing of the lid. The lid and the locking latch control access to the interior of the container. The superior surface of the lid forms a replacement horizontal surface. The fastening device attaches the container to the overbed table. The cupholder attaches to the container. The cupholder provides an alternate storage arrangement for a beverage that does not require space on the replacement horizontal surface.

19 Claims, 5 Drawing Sheets

(56) References Cited

U.S. PATENT DOCUMENTS

| | | | | |
|---|---|---|---|---|
| 7,314,010 | B2 | 1/2008 | George | |
| D574,150 | S * | 8/2008 | Ross | D3/272 |
| 8,316,777 | B1 | 11/2012 | Rosing | |
| D750,340 | S | 2/2016 | Stemen | |
| 9,301,602 | B2 * | 4/2016 | Cardon | A47B 23/06 |
| 9,635,933 | B2 | 5/2017 | Rosing | |
| 9,642,455 | B1 | 5/2017 | Albert | |
| 2009/0050028 | A1 * | 2/2009 | Liao Fang | A47B 13/12 108/26 |
| 2009/0151607 | A1 | 6/2009 | McLemore | |
| 2011/0175506 | A1 | 7/2011 | Davis | |
| 2016/0135586 | A1 * | 5/2016 | Neudeck | A01K 63/006 312/114 |

* cited by examiner

OVERBED TABLE LOCKER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including tables and desks adapted for a particular purpose, more specifically, an overbed table characterized by association with auxiliary devices.

A patient with restricted mobility often requires assistance within a nursing facility. Unfortunately, many nursing facilities have staff limitations that limit the amount of practical care that the patient can receive. This limitation requires that a patient, particularly a bedridden patient, keep desired domestic articles on horizontal surfaces near the patient. Unfortunately, the only suitable horizontal surface accessible to the patient is often a single traditional overbed table. The typical traditional overbed table presents a horizontal surface of 32.25 inches (81.9 cm)×15.375 inches (39.0 cm). A patient will commonly use the horizontal surface provided by the traditional overbed table to: 1) receive meals and beverages; 2) store personal domestic articles; 3) receive, review and generate documents of a personal nature; and, 4) enjoy entertainment activities. A patient must also secure their items from theft when the patient is moved from the room for appointments or other activities. As the need for a horizontal surface by the bedridden patient changes, the items on the horizontal surface of the traditional overbed table must often be moved and replaced. Unfortunately, the only alternate horizontal surface accessible to a bedridden patient has is often the bed they are in. This procedure is especially problematic when cups of liquids, like coffee, are stored on the horizontal surface.

Clearly, a method to improve the storage capacity and the security of the horizontal surface of a traditional overbed table without changing the size of the traditional overbed table would be of benefit in this situation.

SUMMARY OF INVENTION

This disclosure addresses the limitation of a traditional overbed table. The overbed table locker is a locking case. The overbed table locker is configured for use with a traditional overbed table. The traditional overbed table further comprises a tabletop. The overbed table locker is configured for use with domestic articles. The overbed table locker attaches to the superior horizontal surface of the tabletop of the traditional overbed table. The overbed table locker: 1) securely stores the domestic articles within the structure of the overbed table locker; and, 2) forms a replacement horizontal surface that replaces the horizontal surface lost by the attachment of the overbed table locker to the tabletop. The overbed table locker comprises a container, a lid, a plurality of hinges, a plurality of lid supports, a locking latch, a fastening device, and a cupholder. The plurality of hinges attaches the lid to the container. The plurality of lid supports controls the opening and the closing of the lid. The lid and the locking latch control access to the interior of the container. The superior surface of the lid forms the replacement horizontal surface. The fastening device attaches the container to the traditional overbed table. The cupholder attaches to the container. The cupholder provides an alternate storage arrangement for a beverage that does not require space on the replacement horizontal surface.

These together with additional objects, features and advantages of the overbed table locker will be readily apparent to those of ordinary skill in the art upon reading the following detailed description of the presently preferred, but nonetheless illustrative, embodiments when taken in conjunction with the accompanying drawings.

In this respect, before explaining the current embodiments of the overbed table locker in detail, it is to be understood that the overbed table locker is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the overbed table locker.

It is therefore important that the claims be regarded as including such equivalent construction insofar as they do not depart from the spirit and scope of the overbed table locker. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
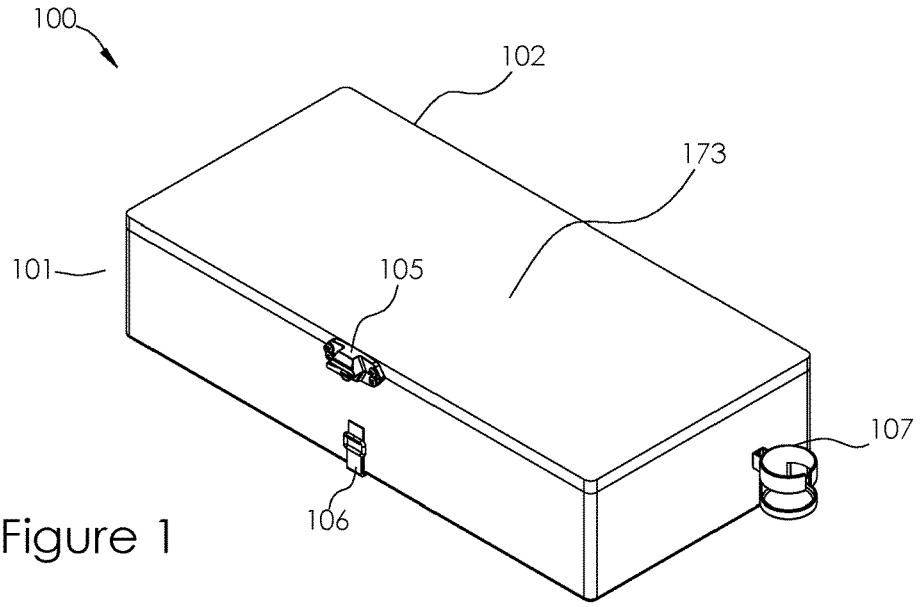
FIG. 1 is a perspective closed view of an embodiment of the disclosure.
Figure 2:
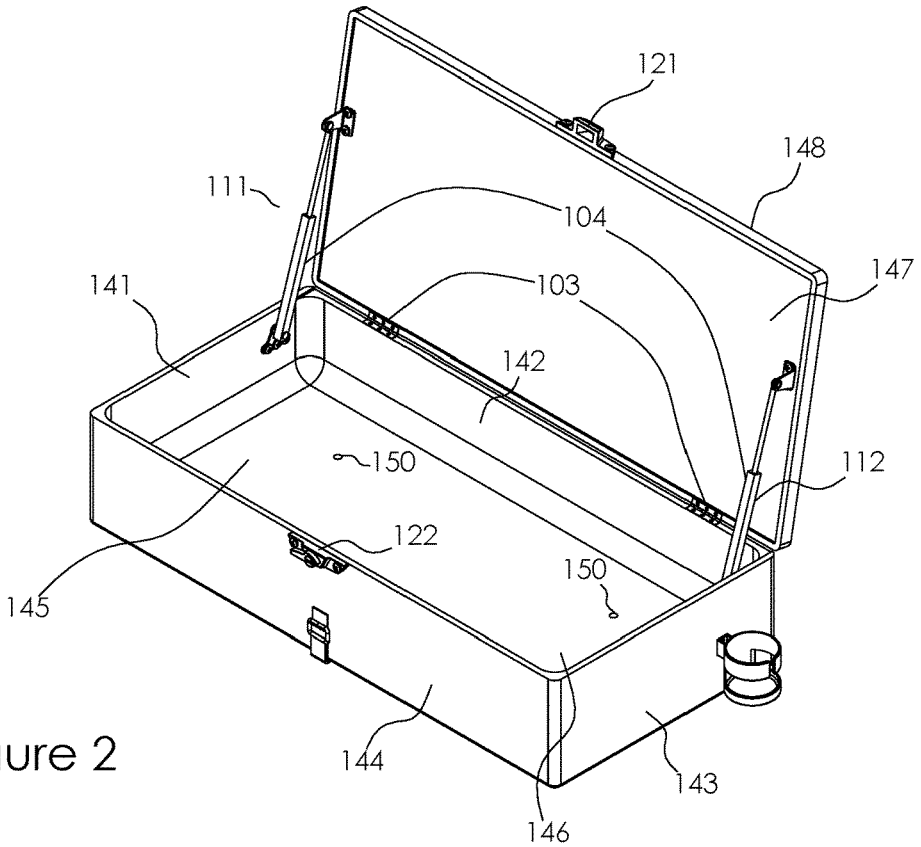
FIG. 2 is a perspective open view of an embodiment of the disclosure.
Figure 3:
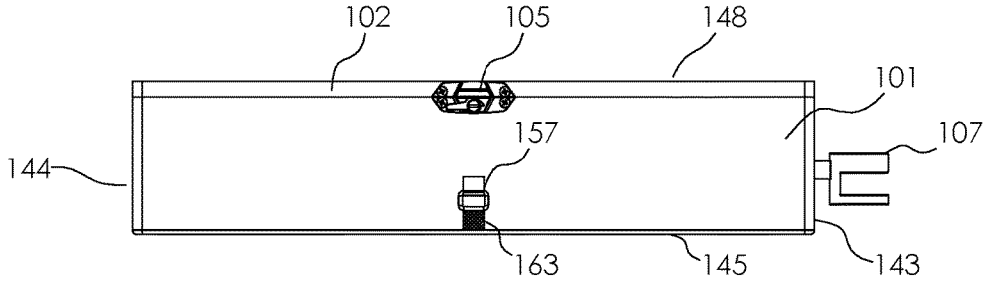
FIG. 3 is a front view of an embodiment of the disclosure.
Figure 4:
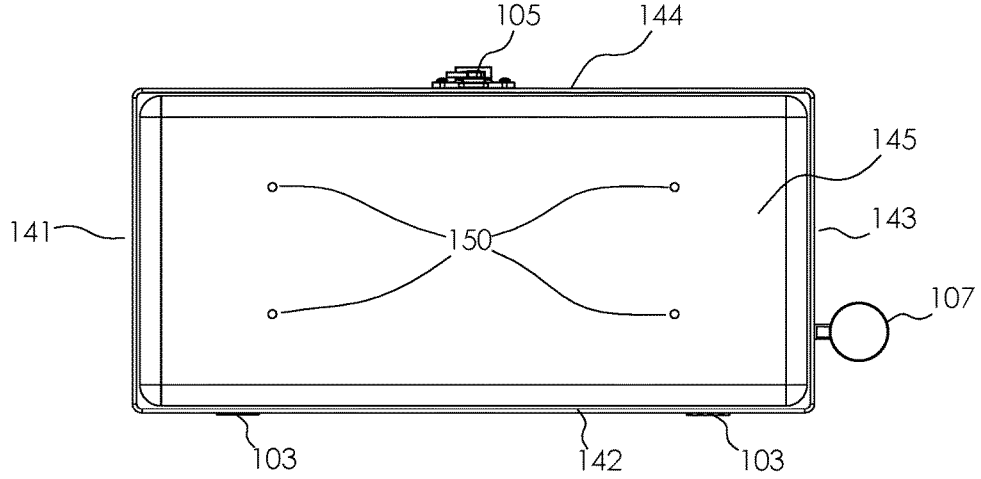
FIG. 4 is a bottom view of an embodiment of the disclosure.
Figure 5:
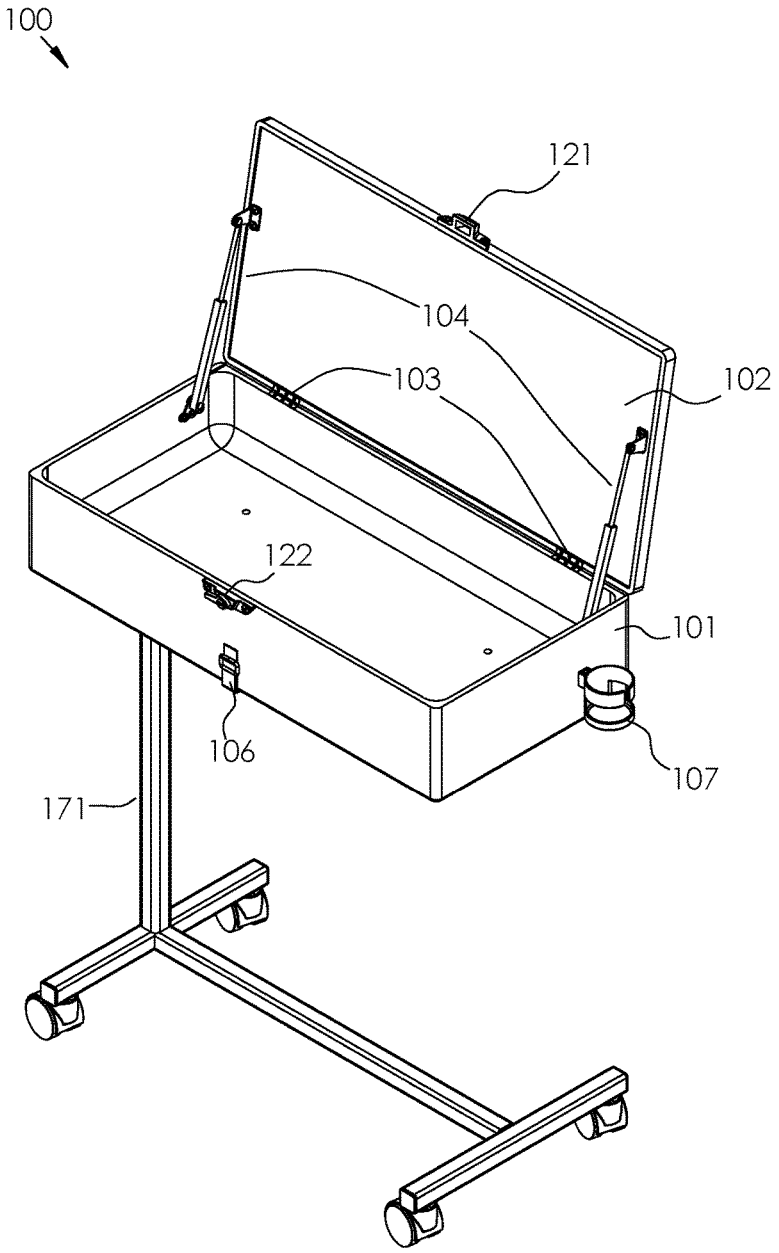
FIG. 5 is an in-use open view of an embodiment of the disclosure.
Figure 6:
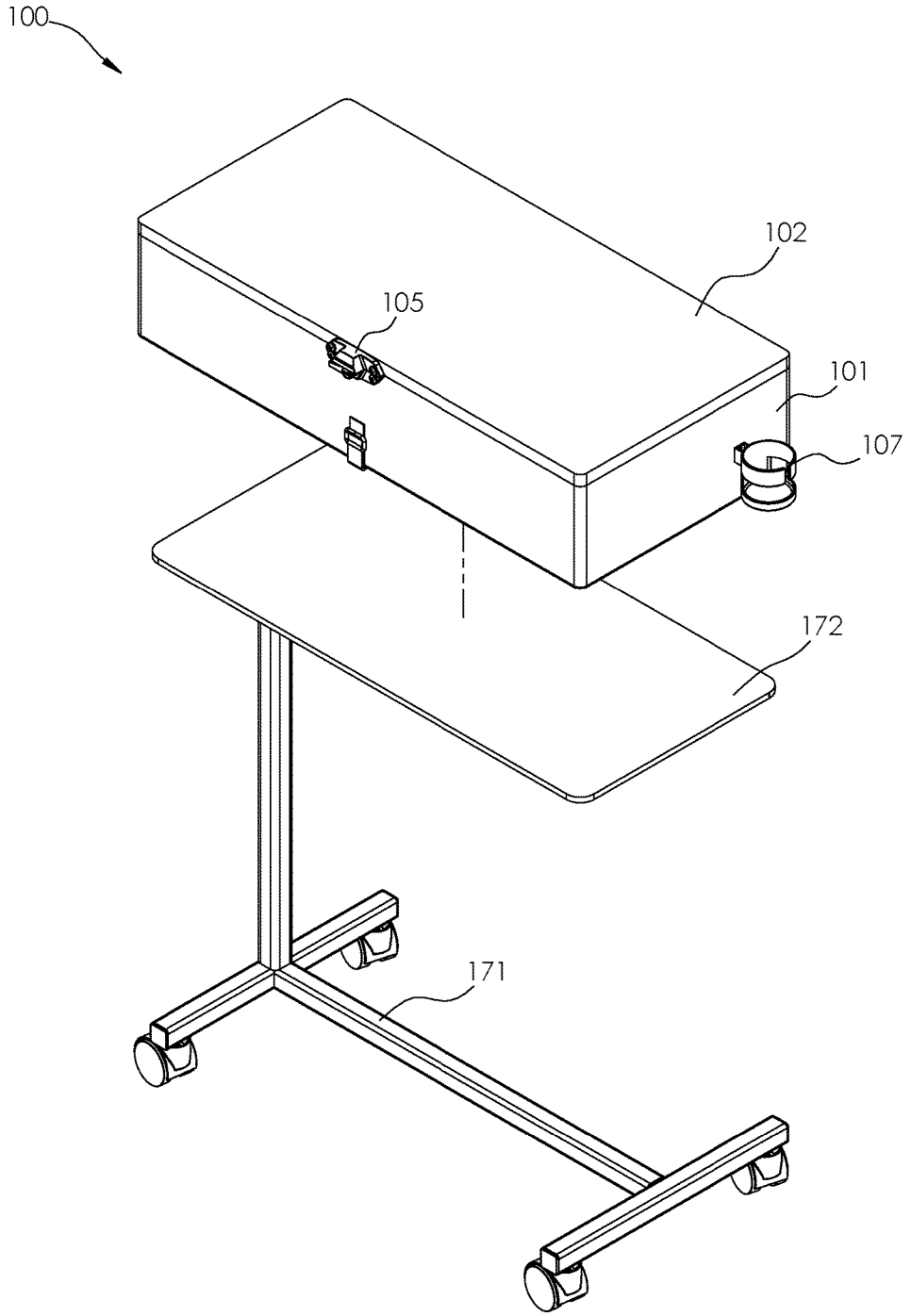
FIG. 6 is an exploded closed view of an embodiment of the disclosure.
Figure 7:
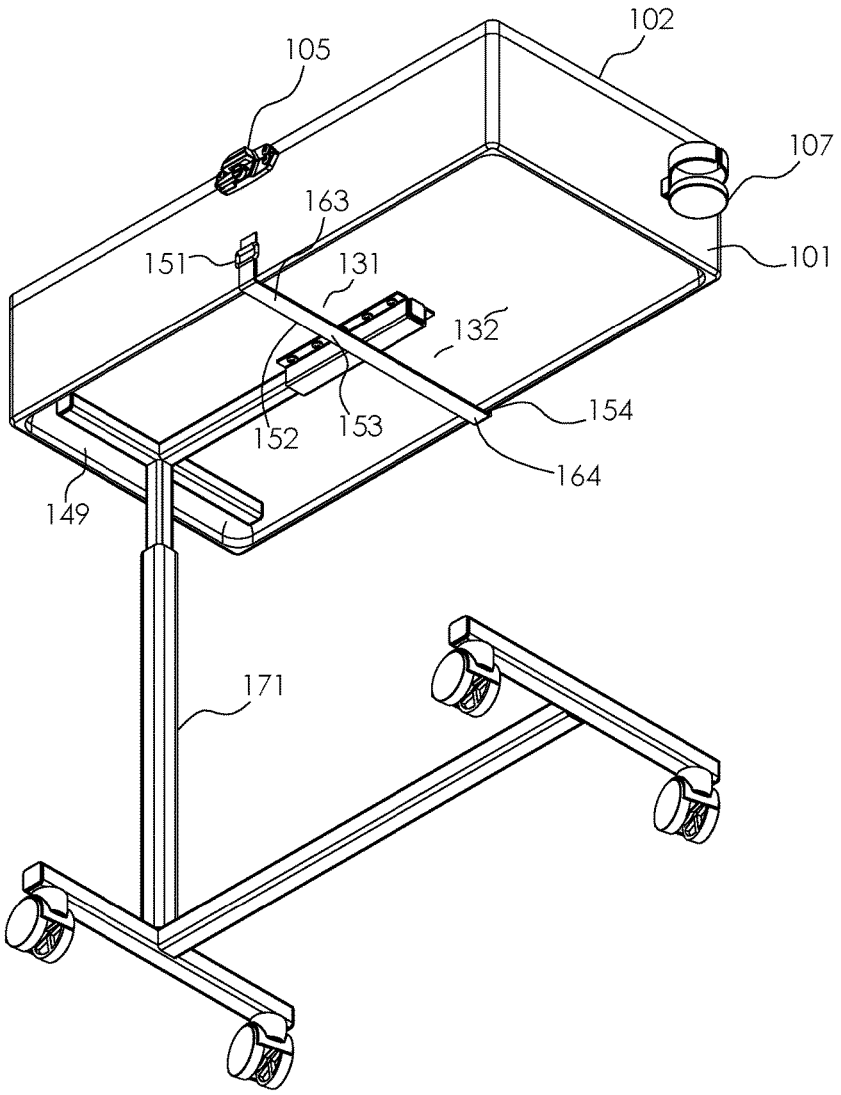
FIG. 7 is an inferior perspective view of an embodiment of the disclosure.

Detailed reference will now be made to one or more potential embodiments of the disclosure, which are illustrated in FIGS. 1 through 7.

The overbed table locker 100 (hereinafter invention) is a locking case. The invention 100 is configured for use with a traditional overbed table 171. The traditional overbed table 171 further comprises a tabletop 172. The invention 100 is configured for use with domestic articles. The invention 100 attaches to the superior horizontal surface of the tabletop 172 of the traditional overbed table 171. The invention 100: 1) securely stores the domestic articles within the structure of the invention 100; and, 2) forms a replacement horizontal surface 173 that replaces the horizontal surface lost by the attachment of the invention 100 to the tabletop 172. The invention 100 comprises a container 101, a lid 102, a plurality of hinges 103, a plurality of lid supports 104, a locking latch 105, a fastening device 106, and a cupholder 107. The plurality of hinges 103 attaches the lid 102 to the container 101. The plurality of lid supports 104 controls the opening and the closing of the lid 102. The lid 102 and the locking latch 105 controls access to the interior of the container 101. The superior surface of the lid 102 forms the replacement horizontal surface 173. The fastening device 106 attaches the container 101 to the traditional overbed table 171. The cupholder 107 attaches to the container 101. The cupholder 107 provides an alternate storage arrangement for a beverage that does not require space on the replacement horizontal surface 173.

The container 101 is a hollow rectangular block structure. The interior space of the container 101 forms the storage space for domestic articles. The perimeter of the container 101 is geometrically identical to the perimeter of the traditional overbed table 171 such that the container 101 aligns with the traditional overbed table 171 when the container 101 rests on the traditional overbed table 171. The container 101 is further defined with a first face 141, a second face 142, a third face 143, a fourth face 144, a fifth face 145, and a sixth face 146. The sixth face 146 of the container 101 is open such that domestic articles can be introduced and removed from the container 101.

The first face 141 is a plate formed with a rectangular block structure. The first face 141 forms a vertical face of the container 101. The second face 142 is a plate formed with a rectangular block structure. The second face 142 forms a vertical face of the container 101. The third face 143 is a plate formed with a rectangular block structure. The third face 143 forms a vertical face of the container 101. The outer dimension of the third face 143 is identical to the outer dimension of the first face 141. The fourth face 144 is a plate formed with a rectangular block structure. The fourth face 144 forms a vertical face of the container 101. The outer dimension of the fourth face 144 is identical to the outer dimension of the second face 142.

The thicknesses of the first face 141, the second face 142, the third face 143, and the fourth face 144 are identical. The vertical heights of the first face 141, the second face 142, the third face 143, and the fourth face 144 are identical. The span of the length of the second face 142 is greater than the span of the length of the first face 141. The third face 143 is distal from the first face 141. The fourth face 144 is distal from the second face 142.

The fifth face 145 is a plate formed with a rectangular block structure. The fifth face 145 forms the inferior horizontal face of the container 101. The outer dimension of the fifth face 145 are geometrically identical to the outer dimensions of the tabletop 172. The sixth face 146 is an open face that forms the superior boundary of the container 101. The sixth face 146 is distal from the fifth face 145.

In the first potential embodiment of the disclosure, the brink formed at the fifth face 145 and the first face 141 is rounded. The brink formed at the fifth face 145 and the second face 142 is rounded. The brink formed at the fifth face 145 and the third face 143 is rounded. The brink formed at the fifth face 145 and the fourth face 144 is rounded.

In the first potential embodiment of the disclosure, the fifth face 145 is further formed with a recess 149. The recess 149 is a cavity formed in the inferior surface of the fifth face 145. The recess 149 is sized to receive the tabletop 172 such that the container 101 will not shift while placed on the overbed table 171.

In the first potential embodiment of the disclosure, the fifth face 145 is further formed with a recess 149. The recess 149 is a cavity formed in the inferior surface of the fifth face 145. The recess 149 is sized to receive the tabletop 172 such that the container 101 will not shift while placed on the overbed table 171. The recess 149 is a cavity formed in the inferior surface of the fifth face 145. The recess 149 is sized to receive the tabletop 172 such that the container 101 will not shift while placed on the overbed table 171.

In the first potential embodiment of the disclosure, the fifth face 145 is further formed with a plurality of mounting holes 150. The plurality of mounting holes 150 are apertures that are formed through the fifth face 145. The plurality of mounting holes 150 are used to bolt the invention 100 to the overbed table 171.

The lid 102 is a plate structure formed in the shape of a rectangular block. The perimeter of the lid 102 is geometrically identical to the perimeter of the container 101 such that the lid 102 aligns with the container 101 when the lid 102 rests on the container 101. The lid 102 covers the sixth face 146 of the container 101 such that the interior space of the container 101 is enclosed. The lid 102 is further defined with a seventh face 147 and an eighth face 148. The seventh face 147 is the face of the lid 102 that is proximal to the container 101. The seventh face 147 is geometrically identical to the fifth face 145. The eighth face 148 is the face of the lid 102 that is distal from the seventh face 147. The eighth face 148 is geometrically identical to the seventh face 147.

Each of the plurality of hinges 103 is a commercially available hinge. The plurality of hinges 103 attaches the lid 102 to the container 101 such that the lid 102 rotates relative to the sixth face 146 of the container 101. This rotation of the lid 102 controls access to the interior space of the container 101. In the first potential embodiment of the disclosure, the plurality of hinges 103 comprises two identical commercially available hinges that are not longer than two inches.

In the first potential embodiment of the disclosure, each of the plurality of lid supports 104 is a commercially available pneumatic arm. The plurality of lid supports 104 attach the lid 102 to the container 101 in a manner that dampens and controls the motion of the lid 102 relative to the container 101. The plurality of lid supports 104 comprises a first pneumatic arm 111 and a second pneumatic arm 112.

The first pneumatic arm 111 supports the lid 102 above the container 101 allowing free access into the container 101. The first pneumatic arm 111 can be locked such that the lid 102 will remain in an open position. The second pneumatic arm 112 supports the lid 102 above the container 101 allowing free access into the container 101. The second pneumatic arm 112 can be locked such that the lid 102 will remain in an open position. The first pneumatic arm 111 and the second pneumatic arm 112 are identical.

In a second potential embodiment of the disclosure, the functionality of each individual hinge selected from the plurality of hinges 103 is merged with the functionality of an individual lid support selected from the plurality of lid supports 104 to form a single component called a lid stay. Each lid stay is a commercially available product. In the second potential embodiment of the disclosure, the lid stay is a spring based device instead of a pneumatic device.

The locking latch 105 is a commercially available hardware product. The locking latch 105 is a device that secures the lid 102 to the container 101. The locking latch 105 is configured to lock such that the locked locking latch 105 prevents unauthorized access to the interior space of the container 101. The use of a locking latch 105 is well-known and documented in the mechanical and hardware arts. The locking latch 105 comprises a superior component 121 and an inferior component 122. The superior component 121 is removably attaches to the inferior component 122. The superior component 121 permanently attaches to the lid 102. The inferior component 122 permanently attaches to the container 101. The locking latch 105 has a locking mechanism that locks the superior component 121 and the inferior component 122 in place when the superior component 121 and the inferior component 122 are joined together.

The fastening device 106 is a mechanical apparatus that attaches the container 101 to the traditional overbed table 171. The fastening device 106 comprises a first hook/loop surface 131 and a second hook/loop surface 132.

The first hook/loop surface 131 attaches to a first strap 163 to bind the container 101 to the traditional overbed table 171. The first strap 163 is a commercially available textile webbing. The first strap 163 is further defined with a first end 151 and a second end 152. The second hook/loop surface 132 attaches to a second strap 164 to bind the container 101 to the traditional overbed table 171. The second hook/loop surface 132 attaches the first hook/loop surface 131 to secure the container 101 to the overbed table 171. The second strap 164 is a commercially available textile webbing. The second strap 164 is further defined with a third end 153 and a fourth end 154. The fastening device 106 is secured by pressing the first hook/loop surface 131 to the second hook/loop surface 132. The use of hook and loop fasteners along with hook/loop surfaces is well known and documented in the apparel and textile arts.

The cupholder 107 is a well-known and documented device that is used to store a beverage container such as a bottle or a cup.

The following three paragraphs describe the assembly and use of the invention 100.

The plurality of hinges 103 attaches the seventh face 147 of the lid 102 to the interior surface of the second face 142 of the container 101. The first pneumatic arm 111 attaches the interior surface of the first face 141 of the container 101 to the seventh face 147 of the lid 102. The second pneumatic arm 112 attaches the interior surface of the third face 143 of the container 101 to the seventh face 147 of the lid 102. The superior component 121 of the locking latch 105 attaches to the seventh face 147 of the lid 102. The inferior component 122 of the locking latch 105 attaches to the exterior surface of the fourth face 144 of the container 101. The cupholder 107 attaches to the exterior surface of the third face 143 of the container 101. The second hook/loop surface 132 of the fastening device 106 attaches to the exterior surface of the fourth face 144 of the container 101.

The container 101 attaches to the tabletop 172 of the traditional overbed table 171 by looping the first strap 163 and the second strap 164 around the interior surface of the tabletop 172. The container 101 is oriented on the tabletop 172 such that the fifth face 145 of the container 101 rests on the tabletop 172. In this configuration, the eighth face 148 of the lid 102 becomes the replacement horizontal surface 173 when the lid 102 is in the closed position.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Bedridden: As used in this disclosure, bedridden refers to a condition of a patient that confines a patient to a bed.

Bind: As used in this disclosure, to bind is a verb that means to tie or secure a first object to a second object using a cord or webbing.

Brink: As used in this disclosure, a brink refers to the discontinuous edge or line formed by the intersection of a first plane or surface and a second plane or surface wherein a cant exists between the first plane or surface and the second plane or surface.

Bung: As used in this disclosure, a bung is a frustum of a cone wherein the parallel planes that form the frustum are perpendicular to the center axis of the cone. See Truncated Cone Cant: As used in this disclosure, a cant is an angular deviation from one or more reference lines (or planes) such as a vertical line (or plane) or a horizontal line (or plane).

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Correspond: As used in this disclosure, the term correspond is used as a comparison between two or more objects wherein one or more properties shared by the two or more objects match, agree, or align within acceptable manufacturing tolerances.

Domestic Article: As used in this disclosure, a domestic article is an item or object: 1) that is commonly found within a household; or, 2) that is commonly carried by a person. Examples of domestic articles include, but are not limited to, keys and key fobs, personal data devices, glasses, remote controls, or personal storage items such as purses, briefcases, wallets, or cases.

Exterior: As used in this disclosure, the exterior is used as a relational term that implies that an object is not contained within the boundary of a structure or a space.

Fastener: As used in this disclosure, a fastener is a device that is used to join or affix two objects. Fasteners generally comprise a first element which is attached to the first object and a second element which is attached to the second object such that the first element and the second element join to affix the first object and the second object. Common fasteners include, but are not limited to, hooks, zippers, magnets, snaps, buttons, buckles, quick release buckles, or hook and loop fasteners.

Force of Gravity: As used in this disclosure, the force of gravity refers to a vector that indicates the direction of the pull of gravity on an object at or near the surface of the earth.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hinge: As used in this disclosure, a hinge is a device that permits the turning, rotating, or pivoting of a first object relative to a second object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior: As used in this disclosure, the interior is used as a relational term that implies that an object is contained within the boundary of a structure or a space.

Latch: As used in this disclosure, a latch is a fastening or locking mechanism. The use of the term latch does not necessarily but often implies the insertion of an object into a notch or cavity.

Lid: As used in this disclosure, a lid is a removable cover that is placed over an opening of a hollow structure to enclose the hollow structure.

Lock: As used in this disclosure, a lock is a fastening device that is released through the use of a key, a numeric or alphanumeric combination, or a biometric identification protocol.

Loop: As used in this disclosure, a loop is the length of a first structure including, that is folded or curved to form a closed or nearly closed space such that a linear structure such as a second line, a cord or a hook inserts through the space formed within the first structure. Within this disclosure, the first structure is said to be looped around the linear structure.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Patient: As used in this disclosure, a patient is a person who is designated to receive a medical treatment, therapy or service. The term patient may be extended to an animal when used within the context of the animal receiving veterinary treatment or services Perimeter: As used in this disclosure, a perimeter is one or more curved or straight lines that bounds an enclosed area on a plane or surface. The perimeter of a circle is commonly referred to as a circumference.

Pneumatic: As used in this disclosure, pneumatic refers to a device wherein the movement of the device is powered using a fluid under pressure.

Pneumatic Arm: As used in this disclosure, a pneumatic arm is a well-known and commercially available pneumatic device that is commonly called a door closer. This disclosure assumes: 1) that a pneumatic arm can be locked into position to hold the door in a fixed open position; and, 2) that a pneumatic arm controls the rate of closure of the door.

Rectangular Block: As used in this disclosure, a rectangular block refers to a three-dimensional structure comprising six rectangular surfaces formed at right angles. Within this disclosure, a rectangular block may further comprise rounded edges and corners.

Rounded: A used in this disclosure, the term rounded refers to the replacement of an apex, vertex, or edge or brink of a structure with a (generally smooth) curvature wherein the concave portion of the curvature faces the interior or center of the structure.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Superior: As used in this disclosure, the term superior refers to a directional reference that is parallel to and in the opposite direction of the force of gravity.

Textile: As used in this disclosure, a textile is a material that is woven, knitted, braided or felted. Synonyms in common usage for this definition include fabric and cloth.

Tradition: As used in this disclosure, a tradition refers to: 1) a set of thoughts or expectations regarding a subject or object; or, 2) a method of using an object; that, 3) is perceived to be widely or commonly shared across a population of people; and that, 4) is perceived to be widely or commonly shared across at least two generations within the population of people.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A locking case comprising:

a container, a lid, a plurality of hinges, a plurality of lid supports, a locking latch, a fastening device, and a cupholder;

wherein the plurality of hinges attaches the lid to the container;

wherein the plurality of lid supports controls the opening and the closing of the lid;

wherein the lid and the locking latch controls access to the interior of the container;

wherein the fastening device attaches the container to a traditional overbed table;

wherein the cupholder attaches to the container;

wherein the locking case is configured for use with a traditional overbed table;

wherein the traditional overbed table further comprises a tabletop;

wherein the locking case attaches to a superior horizontal surface of the tabletop of the traditional overbed table;

wherein the locking case forms a replacement horizontal surface that replaces the horizontal surface lost by the attachment of the locking case to the tabletop;

wherein a superior surface of the lid forms the replacement horizontal surface.

2. The locking case according to claim 1 wherein the container is a hollow rectangular block structure;

wherein a perimeter of the container is geometrically identical to the perimeter of the traditional overbed table such that the container aligns with the traditional overbed table when the container rests on the traditional overbed table;

wherein the container further comprises with a first face, a second face, a third face, a fourth face, a fifth face, and a sixth face;

wherein the sixth face of the container is open.

3. The locking case according to claim 2 wherein the first face is a plate formed with a rectangular block structure;

wherein the second face is a plate formed with a rectangular block structure;

wherein the third face is a plate formed with a rectangular block structure;

wherein the fourth face is a plate formed with a rectangular block structure;

wherein the first face forms a vertical face of the container;

wherein the second face forms a vertical face of the container;

wherein the third face forms a vertical face of the container;

wherein the fourth face forms a vertical face of the container;

wherein an outer dimension of the third face is identical to the outer dimension of the first face;

wherein the outer dimension of the fourth face is identical to the outer dimension of the second face;

wherein the third face is distal from the first face;

wherein the fourth face is distal from the second face.

4. The locking case according to claim 3 wherein a thicknesses of the first face, the second face, the third face, and the fourth face are identical;

wherein a vertical heights of the first face, the second face, the third face, and the fourth face are identical;

wherein a span of the length of the second face is greater than the span of the length of the first face.

5. The locking case according to claim 4 wherein the fifth face is a plate formed with a rectangular block structure;

wherein the fifth face forms an inferior horizontal face of the container;

wherein an outer dimension of the fifth face are geometrically identical to the outer dimensions of the tabletop.

6. The locking case according to claim 5 wherein the sixth face is an open face wherein the sixth face forms a superior boundary of the container;

wherein the sixth face is distal from the fifth face.

7. The locking case according to claim 6
wherein the lid is a plate structure formed in the shape of a rectangular block;
wherein a perimeter of the lid is geometrically identical to the perimeter of the container such that the lid aligns with the container when the lid rests on the container;
wherein the lid covers the sixth face of the container such that an interior space of the container is enclosed.

8. The locking case according to claim 7
wherein the lid further comprises a seventh face and an eighth face;
wherein the seventh face is the face of the lid that is proximal to the container;
wherein the seventh face is geometrically identical to the fifth face;
wherein the eighth face is the face of the lid that is distal from the seventh face;
wherein the eighth face is geometrically identical to the seventh face.

9. The locking case according to claim 8 wherein the plurality of hinges attaches the lid to the container such that the lid rotates relative to the sixth face of the container.

10. The locking case according to claim 9
wherein the plurality of lid supports attach the lid to the container;
wherein the plurality of lid supports controls the movement of the lid.

11. The locking case according to claim 10
wherein the plurality of lid supports comprises a first pneumatic arm and a second pneumatic arm;
wherein the first pneumatic arm can be locked such that the lid will remain in an open position;
wherein the second pneumatic arm can be locked such that the lid will remain in an open position;
wherein the first pneumatic arm and the second pneumatic arm are identical.

12. The locking case according to claim 11
wherein the locking latch secures the lid to the container;
wherein the locking latch prevents unauthorized access to the interior space of the container.

13. The locking case according to claim 12
wherein the locking latch comprises a superior component and an inferior component;
wherein the superior component permanently attaches to the lid;
wherein the inferior component permanently attaches to the container;
wherein the superior component removably attaches to the inferior component.

14. The locking case according to claim 13 wherein the locking latch locks the superior component to the inferior component when the superior component and the inferior component are joined together.

15. The locking case according to claim 14
wherein the fastening device is a mechanical apparatus;
wherein the fastening device attaches the container to the traditional overbed table;
wherein the fastening device comprises a first hook/loop surface, and a second hook/loop surface;
wherein the first hook/loop surface binds the container to the traditional overbed table;
wherein the second hook/loop surface is an anchor point the attaches the first hook/loop surface to the container.

16. The locking case according to claim 15
wherein the first hook/loop surface further comprises a first strap;
wherein the second hook/loop surface further comprises a second strap;
wherein the first strap is a textile webbing;
wherein the second strap is a textile webbing;
wherein the first strap is further defined with a first end and a second end;
wherein the second strap is further defined with a third end and a fourth end.

17. The locking case according to claim 16
wherein the plurality of hinges attaches the seventh face of the lid to an interior surface of the second face of the container;
wherein the first pneumatic arm attaches an interior surface of the first face of the container to the seventh face of the lid;
wherein the second pneumatic arm attaches an interior surface of the third face of the container to the seventh face of the lid;
wherein the superior component of the locking latch attaches to the seventh face of the lid;
wherein the inferior component of the locking latch attaches to the exterior surface of the fourth face of the container;
wherein the cupholder attaches to the exterior surface of the third face of the container.

18. The locking case according to claim 17
wherein the second hook/loop surface of the fastening device attaches to the exterior surface of the fourth face of the container;
wherein the first hook/loop surface attaches to the second hook/loop surface.

19. The locking case according to claim 18
wherein the container attaches to the tabletop of the traditional overbed table by looping the first strap and the second strap around an interior surface of the tabletop;
wherein the attachment of the container is completed by pressing the first hook/loop surface against the second hook/loop surface;
wherein the container is oriented on the tabletop such that the fifth face of the container rests on the tabletop.

* * * * *